US007365617B2

(12) United States Patent
Rostami et al.

(10) Patent No.: US 7,365,617 B2
(45) Date of Patent: Apr. 29, 2008

(54) WIDEBAND ATTENUATOR CIRCUITS AND METHODS

(75) Inventors: Edris Rostami, Los Angeles, CA (US); Rahim Bagheri, Los Angeles, CA (US); Masoud Djafari, Marina Del Rey, CA (US)

(73) Assignee: WiLinx Corp., Los Angeles, CA (US)

( * ) Notice: Subject to any disclaimer, the term of this patent is extended or adjusted under 35 U.S.C. 154(b) by 0 days.

(21) Appl. No.: 11/820,552

(22) Filed: Jun. 19, 2007

(65) Prior Publication Data

US 2007/0247256 A1 Oct. 25, 2007

Related U.S. Application Data

(62) Division of application No. 11/112,060, filed on Apr. 22, 2005.

(51) Int. Cl.
*H01P 7/24* (2006.01)

(52) U.S. Cl. ..... 333/81 R; 327/308

(58) Field of Classification Search ..... 333/81 A, 333/81 R; 327/308

See application file for complete search history.

(56) References Cited

U.S. PATENT DOCUMENTS 4,507,618 A 3/1985 Nelson
6,876,243 B2 4/2005 Behzad

*Primary Examiner*—Stephen E. Jones
(74) *Attorney, Agent, or Firm*—Fountainhead Law Group P.C.; Chad R. Walsh

(57) ABSTRACT

Embodiments of the present invention include wideband attenuator circuits and methods. In one embodiment the present invention includes a first divider circuit coupled in series with two or more second divider circuits. The divider circuits include resistance and capacitance values that may be set according to particular relationships. In one embodiment, a wideband attenuator may include capacitors that are selectively coupled to each output node.

14 Claims, 4 Drawing Sheets

WIDEBAND ATTENUATOR CIRCUITS AND METHODS

CROSS REFERENCE TO RELATED APPLICATIONS

This application is a divisional of and claims the benefit of U.S. patent application Ser. No. 11/112,060, filed Apr. 22, 2005 the disclosure of which is hereby incorporated herein by reference.

BACKGROUND

The present invention relates to attenuators, and in particular, to circuits and methods that may be used in wideband applications.

FIG. 1 illustrates a prior art attenuator. Attenuator 100 is known as an R2R ladder. In an R2R ladder attenuator, a plurality of resistor dividers are configured in series and the output nodes of each divider (i.e., the attenuator "taps") may be coupled to a subsequent stage through switches 141-143. Each tap provides a different attenuation value. In an R2R ladder, resistors 110, 113 and 115-116 have the same value, and resistors 112 and 114 have the same value. Moreover, the value of resistors 112 and 114 is twice the value of the other resistors. Using this configuration, the resistance at each output node to ground is the same. This provides for successive attenuations steps of 6 dB per tap.

One problem with existing attenuators such as attenuator 100 is that the resistance values combine with input capacitance of subsequent stages and will cause the circuit to have a limited bandwidth. For example, if the output taps of attenuator 100 are coupled to the input of an amplifier 150 through switches 141-143, the load capacitance from the switches and from the input of the amplifier will limit the band width of the system. Thus, attenuator 100 may not be useful in wideband applications.

Thus, there is a need for an improved attenuator, and in particular, for wideband attenuator circuits and methods.

SUMMARY

Embodiments of the present invention include wideband attenuator circuits and methods. In one embodiment the present invention includes a wideband attenuator comprising a first divider circuit comprising a first resistance coupled between a first output node and a reference voltage, a first capacitance coupled between the first output node and the reference voltage, a second resistance coupled between a first input node and the first output node, and a second capacitance coupled between the first input node and the first output node, and two or more second divider circuits each comprising a third resistance coupled between a second output node and the reference voltage, a third capacitance coupled between the second output node and the reference voltage, a fourth resistance coupled between a second input node and the second output node, and a fourth capacitance coupled between the second input node and the second output node, wherein each of the two or more second divider circuits are coupled in series and the first divider circuit is coupled to a second output node of the last second divider circuit in the series.

In one embodiment, the value of the second resistance is the same as the value of the fourth resistance, the value of the second capacitance is the same as the value of the fourth capacitance, the value of the first resistance is equal to the third resistance in parallel with the sum of the first resistance and the second resistance.

In one embodiment, the product of the first resistance and first capacitance, the product of the second resistance and second capacitance, and the product of the third resistance and the third capacitance are the equal.

In one embodiment, the third capacitance is approximately equal to zero for a second divider circuit having an output node where an input signal is at one-half amplitude.

In one embodiment, the first divider circuit further includes a fifth capacitance and a first switch for selectively coupling the fifth capacitance in parallel with the first resistance, and wherein said two or more second divider circuits further include two or more second switches for selectively coupling the third capacitance in parallel with the third resistance.

In one embodiment, the product of the first resistance and the sum of the first capacitance and fifth capacitance, the product of the second resistance and second capacitance, and the product of the third resistance and third capacitance are the equal.

In one embodiment, the present invention further comprises a plurality of output switches each having a first terminal coupled to one of said output nodes.

In one embodiment, a first output switch in said plurality of output switches is coupled to the first output node, and when said first output switch is closed, said first switch is open and the two or more second switches are closed.

In one embodiment, a first output switch in said plurality of output switches is coupled to a selected output node of the two or more second output nodes, and when said first output switch is closed, said first switch is closed, a first switch of the two or more second switches that is coupled to the selected output node is open, and the other two or more second switches are closed.

In one embodiment, a buffer is coupled between said attenuator and an amplifier.

The following detailed description and accompanying drawings provide a better understanding of the nature and advantages of the present invention.

DETAILED DESCRIPTION

Described herein are techniques for attenuating signals in electronic systems. In the following description, for purposes of explanation, numerous examples and specific details are set forth in order to provide a thorough understanding of the present invention. However, it will be evident to one skilled in the art that embodiments of the present invention may be used in other applications.

Figure 1:
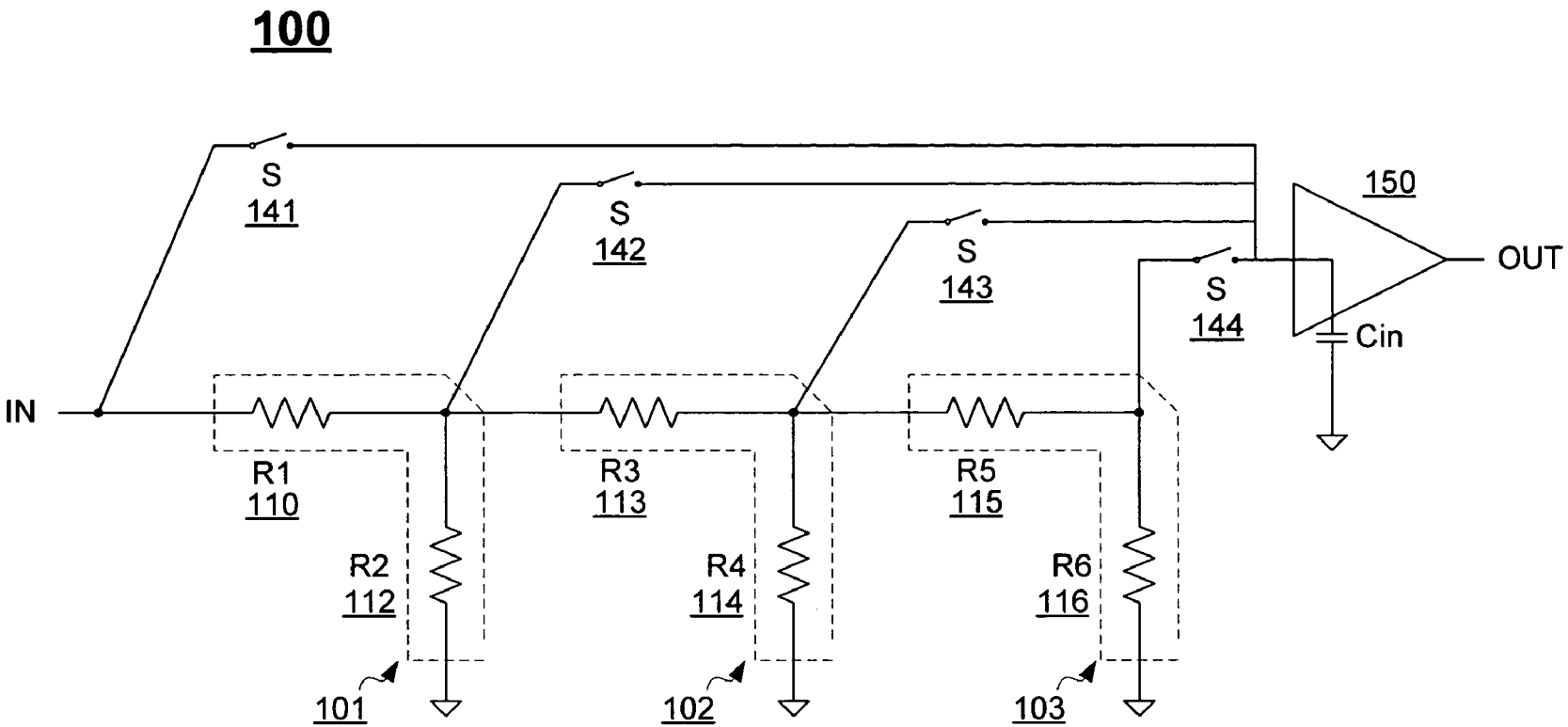
Fig. 1 (Prior Art)
FIG. 1 illustrates a prior art attenuator.
Figure 2:
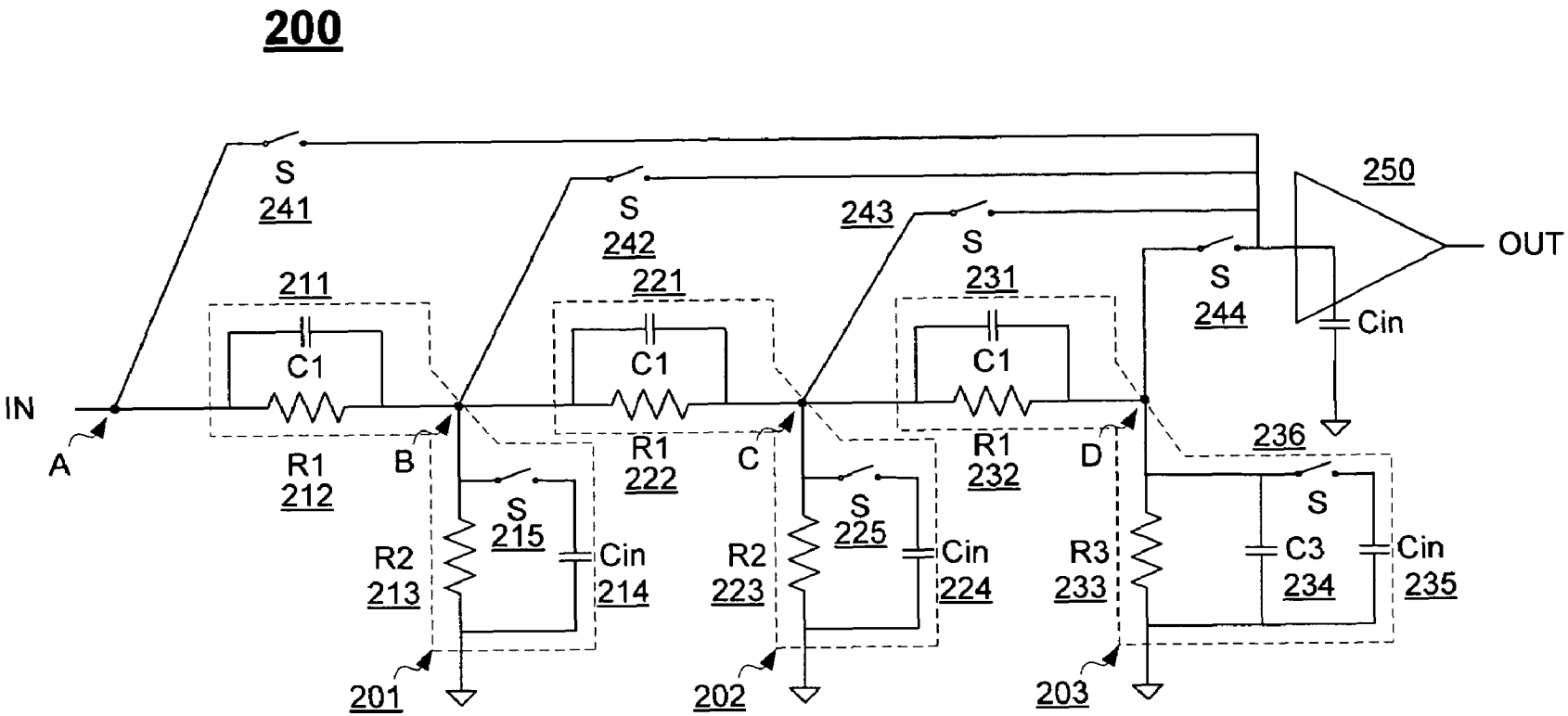
FIG. 2 illustrates a wideband attenuator according to one embodiment of the present invention.

FIG. 2 illustrates a wideband attenuator 200 according to one embodiment of the present invention. Wideband attenuator 200 may be used for attenuating a signal, and also may be used as a variable attenuator in any of a variety of wideband applications including, but not limited to, variable attenuation of signals in wireless applications such as a receiver or variable gain amplifier. Wideband attenuator 200 may be thought of as a plurality of divider circuits coupled in series. Each divider circuit may include an input node and an output node. For example, a first divider circuit 203 may include a first resistance 223 (R3) coupled between a first output node (here, node D) and a reference voltage (e.g., ground), and a first capacitance 234 (C3) coupled between the first output node and ground. The first divider circuit may also include a second resistance 232 (R1) coupled between a first input node (here, node C) and the first output node, and a second capacitance 231 (C1) coupled between the first input node and the first output node.

FIG. 2 also illustrates one example of additional second divider circuits 201 and 202 coupled to first divider circuit 203. In one embodiment, two or more second divider circuits (e.g., 201 and 202) each include a third resistance (R2) coupled between a second output node (here, node C is the output node of divider 202 and node B is the output node of divider 201) and ground, and a third capacitance (Cin) coupled between the second output node and ground. A fourth resistance (R1) is coupled between a second input node and the second output node, and a fourth capacitance (C1) coupled between the second input node and the second output node. In particular, divider circuit 202 includes a resistor 223 (R2) coupled between output node C and ground, a capacitor 224 (Cin) coupled between output node C and ground, resistor 222 (R1) coupled between input node B and the output node C, and capacitor 221 (C1) coupled between input node B and the output node C. Divider circuit 201 includes a resistor 213 (R2) coupled between output node B and ground, a capacitor 214 (Cin) coupled between output node B and ground, resistor 212 (R1) coupled between input node A and the output node B, and capacitor 211 (C1) coupled between input node A and the output node B. Two or more these second divider circuits may be coupled in series. Additional divider circuits may be used in other embodiments. The first divider circuit 203 is coupled to an output node of the last second divider circuit in the series. For example, divider circuit 203 has node C as an input node, which is also the output node for divider 202.

When the divider circuits are coupled in series, wideband attenuator 200 may output signals on nodes A, B, C and D. In one embodiment, the first divider circuit further includes a capacitance 235 (Cin) and a switch 236 for selectively coupling capacitance 235 in parallel with the first resistance 233. Additionally, the two or more second divider circuits further include two or more second switches for selectively coupling the third capacitance (Cin) in parallel with the third resistance (R2). For example, resistors 213 and 223 are coupled between output nodes B and C and a reference voltage (e.g., ground). Furthermore, capacitors 214 and 224 are selectively coupled between output nodes B and C and the reference voltage. Here, each capacitor may be selectively coupled to its respective output node through switches 215 and 225.

Attenuator 200 may further include a plurality of output switches 241-244 that each has a first terminal coupled to one of said output nodes. Output switches 241-244 provide the function of coupling the plurality of output nodes to the subsequent stages, such as an amplifier, for example. In one embodiment, each output node (e.g., A, B, C, and D) is coupled to a switch 241, 242, 243, and 244. Switches 241, 242, 243, and 244 may be used to selectively couple each output node to a subsequent stage, such as amplifier 250. For instance, a first output switch in said plurality of output switches may be coupled to the first output node (i.e., switch 244 coupled to node D), and when said first output switch 244 is closed, switch 236 is open and the two or more second switches (i.e., switches 215 and 225) are closed. Similarly, if a first output switch in said plurality of output switches is coupled to a selected output node of the two or more second output nodes (i.e., if one of switches 241-243 is coupled to any one of nodes A, B, or C), and when said first output switch is closed, said first switch (switch 244) is closed, a first switch of the two or more second switches that is coupled to the selected output node is open, and the other two or more second switches are closed. In other words, if one of the switches 241-244 is closed, then a corresponding capacitor coupled to the same output node as the close switch is selectively decoupled from such output node and the other capacitors coupled between the other output nodes and ground are selectively coupled to the other output nodes. For example, if switch 242 is closed, then the corresponding capacitor 214, which is coupled to the same output node, is decoupled from output node B by opening switch 215. Furthermore, the remaining switches 225 and 236 for the other capacitors are closed. Likewise, if switch 243 is closed, then switch 225 is open and switches 215 and 236 are closed. Finally, if switch 244 is closed, switch 236 is open and switches 215 and 225 are closed.

Features and advantages of the circuit in FIG. 2 include providing wideband attenuation. For example, when the resistance and capacitance values are properly specified, the circuit exhibits good wideband performance. For example, the resistance values of resistors 213 and 223 are substantially the same and designated R2. The resistance values of resistors 212, 222, and 232 are also substantially the same and designated R1. Furthermore, the capacitance values of capacitors 211, 221, and 231 are substantially the same and designated C1, and the capacitance values of capacitors 214, 224 and 235 are substantially the same and set approximately to the value of the load capacitance when an output switch is closed. In this case, the load capacitance is the input capacitance of the subsequent stage (e.g., an amplifier having input capacitance Cin). Resistor 233 has a value of R3 and capacitor 234 has a value of C3. In attenuator 200, the values of R1, R2, C1, C3 and Cin are related as follows:

$$R1 \cdot C1 = R2 \cdot Cin = R3 \cdot (C3 + Cin) \tag{1}$$

$$(R3 + R1) \| R2 = R3 \tag{2}$$

where R1 and R3 define the attenuation steps. From the above equations it can be seen that the input resistance of the network, Rin, is as follows:

$$Rin = R1 + R3 \tag{3}$$

In the wireless applications discussed above, Rin may be given by the design of the high-pass filter sections for DC offset cancellation. The output voltages at each node are given as follows:

$$\frac{V_A}{V_{IN}} = 1,$$

$$\frac{V_B}{V_{IN}} = \frac{R3}{R1 + R3},$$

$$\frac{V_C}{V_{IN}} = \left(\frac{R3}{R1 + R3}\right)^2,$$

$$\frac{V_D}{V_{IN}} = \left(\frac{R3}{R1 + R3}\right)^3.$$

So attenuation per step in dB is given by:

$$A_N = 20 \cdot \log\left(\frac{R3}{R1 + R3}\right) \tag{4}$$

when the product of R3 and the sum of the C3 and Cin, the product of the R2 and C2, and the product of the R1 and C1 are the equal. This may be set by design of the VGA, for example. From (3) and (4), R1 and R3 can be calculated. Then, using equation (1) R2 may be calculated.

One example application is where 6 dB attenuation steps are desired. From equations (1), (2), (3) and (4), 6 dB attenuation steps results in the following:

R1=R3,

R2=2R1,

C1=2Cin, and

C3=Cin.

To calculate the equivalent input capacitance of the wideband attenuator, Cin_wb, we first examine the capacitance to ground at node C, which is Cin in parallel with a capacitance Cc. Cc is given as follows:

$$Cc = C1 \text{ in series with } (C3 \parallel Cin)$$

$$Cc = \left(\frac{C1 \cdot (C3 + Cin)}{C1 + (C3 + Cin)}\right) = \frac{1}{\frac{1}{C1} + \frac{1}{C3 + Cin}}.$$

Applying equation (1), C1 and C3 may be eliminated, which results in the following:

$$Cc = \frac{R2 \cdot Cin}{R1 + R3}. \tag{5}$$

From equations (1) and (2) we know that:

$$\frac{R2}{R1 + R3} = \frac{C3}{Cin} \tag{6}$$

Thus, we have:

$$Cc = Cin\left(\frac{C3}{Cin}\right) = C3. \tag{7}$$

Repeating this calculation for each stage results in the input capacitance of the wideband attenuator, Cin_wb=C3.

If the wideband attenuator is designed for 6 dB steps, then Cin_wb=Cin.

Figure 3:
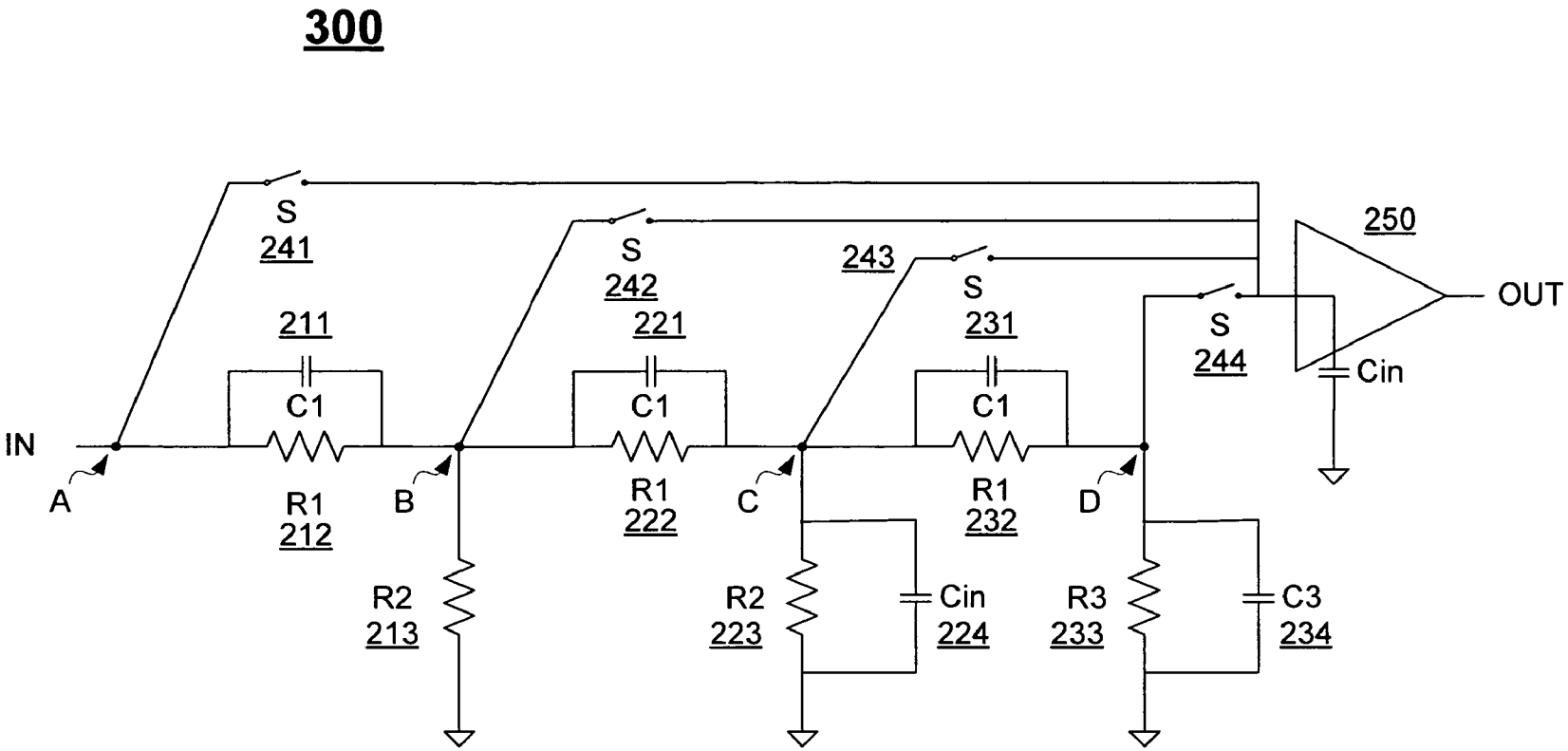
FIG. 3 illustrates a wideband attenuator according to another embodiment of the present invention.

FIG. 3 illustrates a wideband attenuator according to another embodiment of the present invention. In this simplified equivalent embodiment of the attenuator, switches 215, 225, and 236 and capacitor 214 are not included (i.e., the value of these capacitors is zero) and the values of capacitors 234 and 235 are combined. From the perspective of nodes A and B, the resulting output is the same. In particular, when connected to the node B, the behavior of attenuator 300 is the same as attenuator 200. However, nodes C and D will have more capacitance than in the previous embodiment and will decrease the bandwidth of the circuit and may cause some ripple to occur. However, these effects may be reduced by reducing the value of C3 (e.g., 0.9C3) to reduce the capacitance at nodes C and D and come closer to the ideal implementation. The values of capacitances 234 and 224 may be adjusted to optimize performance of the attenuator for a specific application. This embodiment may be advantageous because by eliminating the switches, the corresponding charge injection, complexity and necessary control circuit for controlling the switches is also thereby eliminated.

Furthermore, it should be noted that the resistance from the perspective of the subsequent stage may change as the output switches move from tap to tap. In other words, the resistance looking into node A through switch 241 is different than the resistance looking into node B through switch 242. Similarly, the resistance looking into nodes C and D through switches 243 and 244 may also be different. In particular, the maximum resistance will occur when at the output node of the attenuator where an input signal is at one-half amplitude (i.e., the divide-by-two point). Therefore, in one embodiment, the third capacitance (Cin) is set approximately equal to zero for the second divider circuit that has an output node where an input signal is at one-half amplitude. In attenuator 300, the second divider circuit where the input signal as at one-half amplitude is the divider circuit made up of resistors 212 and 213 and capacitor 211. Thus, capacitor 214 (see FIG. 2) may be set to zero (i.e., eliminated). Since the output node with the divide-by-two point has the largest resistance, such node cannot tolerate any additional capacitance when the output switch is closed. Thus, at the output node with the divide-by-two point, the capacitance to ground is set to zero, which gives the same result as in attenuator 200 of FIG. 2. However, because the other output nodes have lower resistance from the perspective of a subsequent stage, such output nodes may include capacitances (e.g., Cin 224) without critically impacting the bandwidth of the system.

Figure 4:
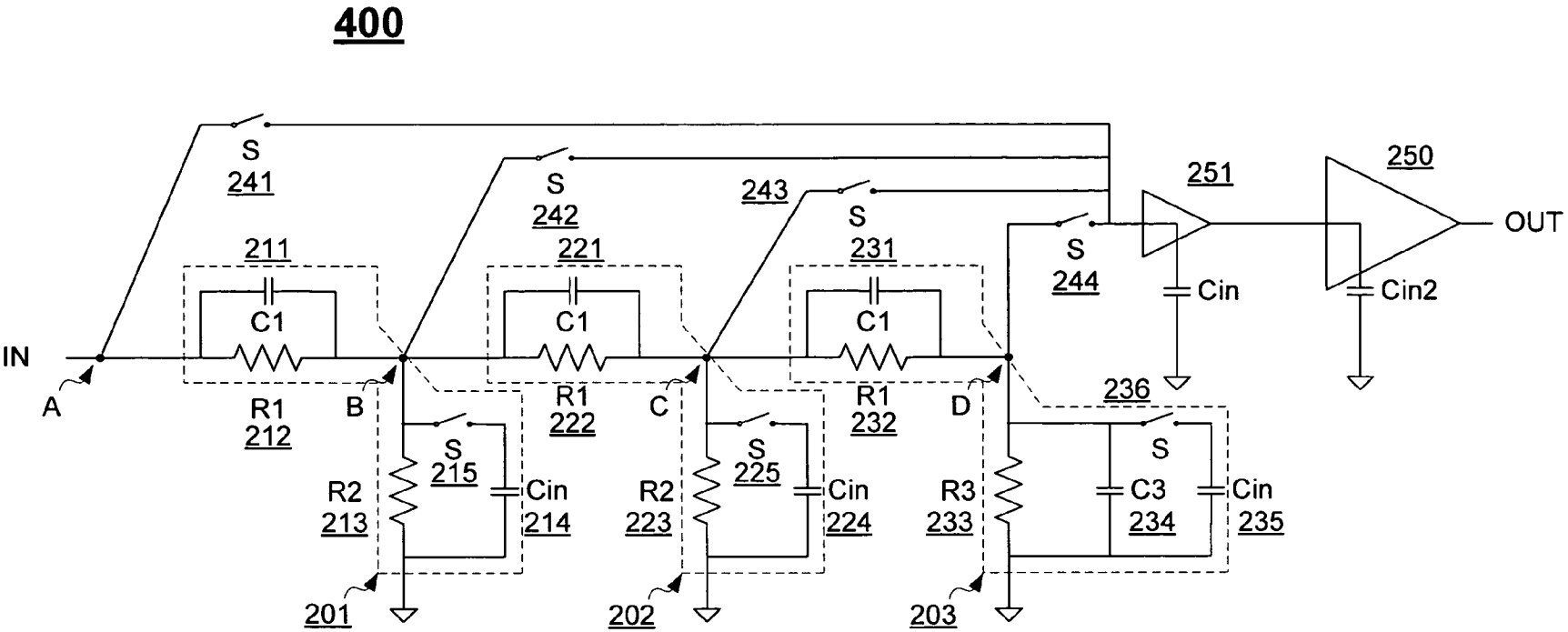
FIG. 4 illustrates a wideband attenuator according to yet another embodiment of the present invention.

FIG. 4 illustrates a wideband attenuator according to yet another embodiment of the present invention. In some applications, it may be desirable to reduce the total input capacitance of the attenuator and subsequent stages. For instance, parasitic input capacitances may create a capacitive divider and cause gain variations when other circuits are coupled to the input of a wideband attenuator described above. To reduce the undesired effects of parasitic capacitance, it may be desirable to reduce the value of Cin at the input of a wideband attenuator. In one embodiment, a low input capacitance buffer 251 may be used between switches 241-244 and amplifier 250. The reduced input capacitance of the buffer will allow a low value of Cin to be used, and thereby reduce gain variations caused by parasitic capacitances. For example, the input capacitance of buffer 251, Cin, may be less than the input capacitance of amplifier 250, Cin2.

Example component values for a wideband attenuator is as follows. The set of values is an example of a wideband attenuator with five output nodes (i.e., a first divider circuit stage and three second divider circuit stages) that includes switches for selectively coupling capacitors to and from each output node depending on which output node is selected: {R1=9 k, R2=18 k, R3=9 k, C1=2 pf, C2=1 pf, C3=1 pf, Cin=1 pf}. values may be used for an implementation of the attenuator in FIG. 3.

The above description illustrates various embodiments of the present invention along with examples of how aspects of the present invention may be implemented. The above examples and embodiments should not be deemed to be the only embodiments, and are presented to illustrate the flexibility and advantages of the present invention as defined by the following claims. Based on the above disclosure and the following claims, other arrangements, embodiments, implementations and equivalents will be evident to those skilled in the art and may be employed without departing from the spirit and scope of the invention as defined by the claims. For example, while the above description was presented in terms of a single ended circuit, it is to be understood that the present invention could be implemented as a differential circuit. The terms and expressions that have been employed here are used to describe the various embodiments and examples. These terms and expressions are not to be construed as excluding equivalents of the features shown and described, or portions thereof, it being recognized that various modifications are possible within the scope of the appended claims. In particular, the term "equal" and "the same" are used to illustrate the relationship between resistance values and capacitance values. It is understood that actual implementations may not be exactly equal or exactly the same, but may be designed using the relationships described herein and modified to meet the requirements of the particular system. It is also to be understood that in a manufacturing environment, circuit components may not be exactly equal or the same even when designed to be so.

What is claimed is:

1. An attenuator comprising:

a first divider circuit comprising a first resistance coupled between a first output node and a reference voltage, a first capacitance coupled between the first output node and the reference voltage, a second resistance coupled between a first input node and the first output node, and a second capacitance coupled between the first input node and the first output node;

one or more second divider circuits each comprising a third resistance coupled between a second output node and the reference voltage, a third capacitance coupled between the second output node and the reference voltage, a fourth resistance coupled between a second input node and the second output node, and a fourth capacitance coupled between the second input node and the second output node; and a third divider circuit comprising a fifth resistance coupled between a third output node and the reference voltage, a sixth resistance coupled between a third input node and the third output node, and a third divider circuit capacitance coupled between the third input node and the third output node, wherein the third input node is coupled to receive a signal to be attenuated, each of the one or more second divider circuits are coupled in series, the third output node is coupled to the second input node of an initial second divider circuit in the series, and the first divider circuit is coupled to a second output node of a last second divider circuit in the series, wherein output nodes of the attenuator are coupled to a subsequent stage having an input capacitance, and wherein the value of the third capacitance in each of the one or more second divider circuits is approximately equal to the input capacitance of the subsequent stage.

2. The attenuator of claim 1 further comprising a first switch coupled the third input node, a second switch coupled to the third output node, one or more intermediate switches coupled to the one or more second output nodes, and a fourth switch coupled to the first output node.

3. The attenuator of claim 1 further comprising a fifth capacitance coupled between third output node and the reference voltage and a seventh capacitance coupled in parallel with the first capacitance.

4. The attenuator of claim 3 wherein the value of the fifth and seventh capacitances are approximately equal to the input capacitance of the subsequent stage.

5. An attenuator comprising:

a first divider circuit comprising a first resistance coupled between a first output node and a reference voltage, a first capacitance coupled between the first output node and the reference voltage, a second resistance coupled between a first input node and the first output node, and a second capacitance coupled between the first input node and the first output node;

one or more second divider circuits each comprising a third resistance coupled between a second output node and the reference voltage, a third capacitance coupled between the second output node and the reference voltage, fourth resistance coupled between a second input node and the second output node, and a fourth capacitance coupled between the second input node and the second output node; and a third divider circuit comprising a fifth resistance coupled between a third output node and the reference voltage, a sixth resistance coupled between a third input node and the third output node, and a third divider circuit capacitance coupled between the third input node and the third output node, wherein the third input node is coupled to receive a signal to be attenuated, each of the one or more second divider circuits are coupled in series, the third output node is coupled to the second input node of an initial second divider circuit in the series, and the first divider circuit is coupled to a second output node of a last second divider circuit in the series, wherein the value of the second resistance is the same as the value of the fourth resistance, the value of the second capacitance is the same as the value of the fourth capacitance, and the value of the first resistance is equal to the third resistance in parallel with the sum of the first resistance and the second resistance.

6. An attenuator comprising:

a first resistor having a first resistance value coupled between a first node and a reference voltage;

a first capacitor having a first capacitance value coupled between the first node and the reference voltage;

a second resistor having a second resistance value coupled between a second node and the first node;

a second capacitor having a second capacitance value coupled between the second node and the first node;

a third resistor having a third resistance value coupled between the second node and the reference voltage;

a third capacitor having a third capacitance value coupled between the second node and the reference voltage;

a fourth resistor having a fourth resistance value approximately equal to the second resistance value coupled between a third node and the second node;

a fourth capacitor having a fourth capacitance value approximately equal to the second capacitance value coupled between the third node and the second node;

a fifth resistor having a fifth resistance value approximately equal to the third resistance value coupled between the third node and the reference voltage;

a sixth resistor having a sixth resistance value approximately equal to the second resistance value coupled between a fourth node and the third node; and a fifth capacitor having a fifth capacitance value approximately equal to the second capacitance value coupled between the fourth node and the third node.

7. The attenuator of claim 6 wherein the value of the first resistance is equal to the value third resistance in parallel with the sum of the first resistance and the second resistance.

8. the attenuator of claim 6 further comprising a first switch coupled between the first node and a fifth node;

a second switch coupled between the second node and the fifth node;

a third switch coupled between the third node and the fifth node; and a fourth switch coupled between the fourth node and the fifth node.

9. The attenuator of claim 6 wherein the product of the first resistance value and first capacitance value, the product of the second resistance value and second capacitance value, and the product of the third resistance value and the third capacitance value are equal.

10. An attenuator comprising:

a first divider circuit comprising a first resistance coupled between a first output node and a reference voltage, a first capacitance coupled between the first output node and the reference voltage, a second resistance coupled between a first input node and the first output node, and a second capacitance coupled between the first input node and the first output node; and two or more second divider circuits each comprising a third resistance coupled between a second output node and the reference voltage, a third capacitance coupled between the second output node and the reference voltage, a fourth resistance coupled between a second input node and the second output node, and a fourth capacitance coupled between the second input node and the second output node; and a subsequent stage circuit having an input coupled to the output nodes of the first divider circuit and two or more second divider circuits through a plurality of switches, wherein each of the two or more second divider circuits are coupled in series and the first divider circuit is coupled to a second output node of the last second divider circuit in the series, and wherein the value of the third capacitance in each of the two or more second divider circuits is approximately equal to the input capacitance of the subsequent stage circuit.

11. The attenuator of claim 10 wherein the subsequent stage circuit is an amplifier.

12. The attenuator of claim 10 wherein an output node of said attenuator at a divide-by-two point has a capacitance to said reference voltage of approximately zero.

13. The attenuator of claim 10 wherein said reference voltage is ground.

14. The attenuator of claim 10 wherein the subsequent stage circuit is a buffer.

* * * * *